United States Patent [19]

Reale

[11] 4,179,860

[45] Dec. 25, 1979

[54] LATERAL STIFFENER FOR STRUT

[75] Inventor: Salvatore J. Reale, Wayne, N.J.

[73] Assignee: Foster Wheeler Energy Corporation, Livingston, N.J.

[21] Appl. No.: 871,899

[22] Filed: Jan. 24, 1978

[51] Int. Cl.[2] ..... E04C 3/30

[52] U.S. Cl. ..... 52/732; 403/384

[58] Field of Search ..... 403/363, 384, 393; 52/693, 694, 695, 728, 730, 732

[56] References Cited

U.S. PATENT DOCUMENTS

| | | | |
|---|---|---|---|
| 1,560,905 | 11/1925 | Estes | 52/728 X |
| 1,656,900 | 1/1928 | Bowen | 52/732 X |
| 1,865,059 | 6/1932 | Ragsdale | 52/694 X |
| 4,038,802 | 8/1977 | Bajorek | 52/728 X |

OTHER PUBLICATIONS

"Manual of Steel Construction" 7th Edition, 1970 ® published by the American Institute of Steel Construction Section 3, p. 59, Single-Angle Struts cited.

"Basic Steel Construction" by B. G. Johnston and F. J. Lin published by Prentice-Hall, 1974 ©, pp. 92–94 cited.

*Primary Examiner*—Wayne L. Shedd

*Attorney, Agent, or Firm*—Marvin A. Naigur; John E. Wilson; John J. Herguth, Jr.

[57] ABSTRACT

An apparatus is provided for preventing buckling of a narrow member which is subjected to a compression load. The apparatus comprises a rigid bar of substantially the same length as the narrow member, having angularly disposed legs adapted to contact the narrow member along its length, with means for maintaining the narrow member in contact with the rigid bar.

8 Claims, 5 Drawing Figures

LATERAL STIFFENER FOR STRUT

BACKGROUND OF THE INVENTION

This invention relates to an apparatus for preventing buckling of narrow members subjected to a compression load, and more particularly, it relates to an apparatus for preventing buckling of narrow members which are ordinarily loaded in tension but on occassion will be loaded in compression, such as hanger rods which are used for top supporting vapor generator components, or pipe truss members used in vapor generator ductwork.

A vapor generator is usually top supported in order to allow for downward expansion of its components, which expansion results from the absorption of heat by the components. A conventional top support system includes an external superstructure, laterally extending beams hung from the superstructure and a plurality of narrow hanger rods connected between the beams and the vapor generator. The hanger rods are normally subjected to a downward load, as a result of the weight of the vapor generator components pulling down on the rods, and are therefore normally under tension. Under normal operating conditions hanger rods not only provide top support for the unit but also prevent the roof from moving downwardly relative to the vapor generator enclosure walls and suspended elements which penetrate the roof at various locations. However if abnormally high positive pressure develops within the furnace enclosure, for example, if as a result of a furnace "PUFF", some hanger rods can be subjected temporarily to a compression load, and tend to buckle since they are relatively slender. Under such conditions the roof tends to move relative to the suspended elements, and seal plates attached between the roof and various suspended elements can be torn free. It is to be understood that seal plates may be designed to accommodate some relative movement, such as by forming corrugation in the plates, but such plates can ordinarily accommodate only the expected slight relative movement resulting from relative thermal expansion. Therefore, it is important that hanger rods be capable of withstanding a compression load in order to preclude relative movement between the roof and suspended elements, and thereby prevent against damaging associated seals.

In long sections of ductwork, such as the ductwork associated with the vapor generator convection section outlet, pipe trusses are often used to provide for structural integrity of the ductwork. During normal operation of the vapor generator there may be a negative pressure within this ductwork, and as a result some of the truss members would be subjected to a tensile load and others subject to a compression load. The truss members expected to be under a tensile load are usually slender pipes, whereas members expected to bear compression loads comprise members of a greater cross sectional area. If a positive pressure develops within the ductwork, those members expected to be in tension may be subjected to a compression load, and other members expected to be under compression may be subjected to a tensile load. The later members ordinarily are capable of withstanding a tensile load, but the slender members tends to buckle when loaded in compression. If these slender members do buckle, the relatively thin sheet metal walls defining the duct may collapse inwardly of the duct since the slender members do not act to resist the compression loading. Hence, as with narrow hanger rods, it becomes important to insure that slender truss members be capable of withstanding a compression load which may occur during periods of pressure excursions within the ductwork.

The instant invention provides means for preventing the buckling of narrow members, such as hanger rods, and/or truss members when they are subjected to a compression load. Therefore when used with a vapor generator top support system the invention precludes relative movement between the vapor generator components and prevents against consequent damage to associated seals, and when used with ductwork pipe trusses the invention precludes buckling of narrow truss members and thereby prevents against damaging the ductwork.

SUMMARY OF THE INVENTION

In accordance with an illustrative embodiment demonstrating features and advantages of the present invention, an apparatus is provided for preventing the buckling of narrow members which are subjected to a compression load which comprises a rigid bar of substantially the same length as the narrow support member and including first and second angularly disposed legs, each leg being adapted to contact the narrow member along its length, and means for maintaining the rigid bar in contact with the narrow support member, the means including a tie bar connected between the legs of the rigid bar and adapted to contact the outer surface of the support member at a point spaced apart from the point of contact of the member with the rigid bar.

BRIEF DESCRIPTION OF THE DRAWINGS

The above brief description, as well as further objects features and advantages of the present invention will be more fully appreciated by reference to the following detailed description of the presently preferred but nonetheless illustrative embodiment in accordance with the present invention when taken in connection with the accompanying drawings, wherein.

DESCRIPTION OF THE PREFERRED EMBODIMENT

Figure 1:
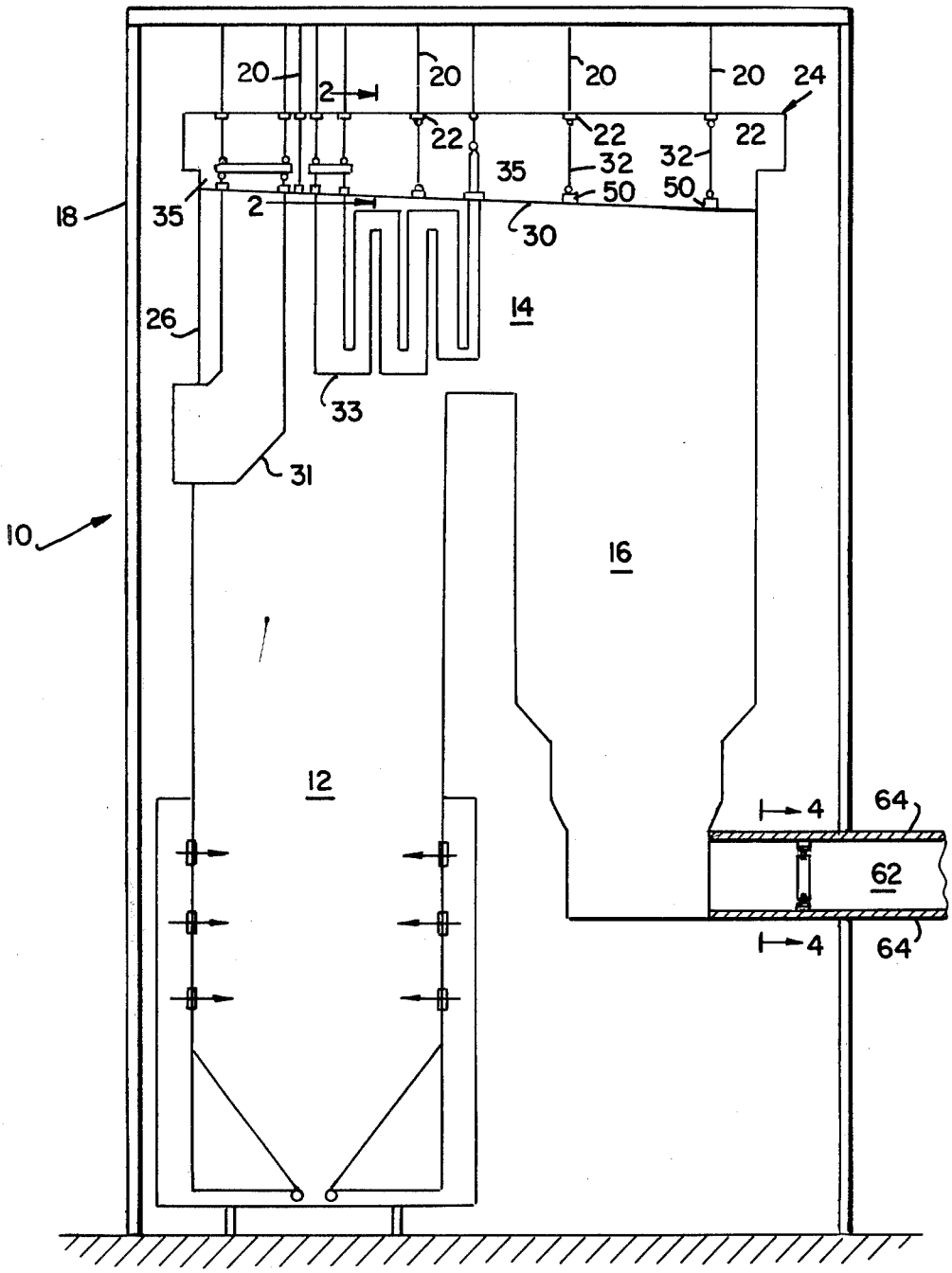
FIG. 1 is an elevational schematic view of a vapor generator incorporating the instant invention.

Referring to FIG. 1 of the drawings, a conventional top-supported vapor generator incorporating the present invention is indicated by reference numeral 10. The vapor generator 10 includes a vertically extending, rectangular upright furnace section 12, a vestibule section 14 and a convection section 16 having an outlet 17, with each section of the vapor generator being top-supported from external superstructure 18 by the use of hanger straps 20 connected to laterally extending beams 22. A penthouse 24 is disposed adjacent the top of the vapor generator and extends from the front wall 26 of the furnace section across the top of the vapor generator back to the rear wall 28 of the convection section 16. The vapor generator 10 includes a roof 30 formed from a plurality of metal tubes extending generally horizontally from the front wall 26 of the furnace section 12 to the rear wall 28 of the convection section 16. A plurality of narrow hanger rods 32 are connected at one end to the support beams 22 and at the other end to the roof 30. Division wall 31 extends within the furnace section 12, and penetrates wall 26 at one end and penetrates the roof 30 adjacent its other end. Superheater 33 is disposed within the vapor generator adjacent the inlet to the vestibule section 14, and penetrates roof 30 at two locations adjacent its inlet and outlet ends. Division wall 31 and superheater 33 are hung from hanger rods and support beams in a manner similar to the manner in which the roof 30 of the vapor generator is hung. At the locations were the division wall 31, and/or superheater 33 penetrate the roof 30, seal plates 35 are installed to prevent furnace gases from escaping into the penthouse 24. It is to be understood that the division wall 31 and superheater 35 are intended to be illustrative of the type of elements which can penetrate the roof 30 yet others including reheaters, and economizers could also penetrate the roof.

Figure 2:
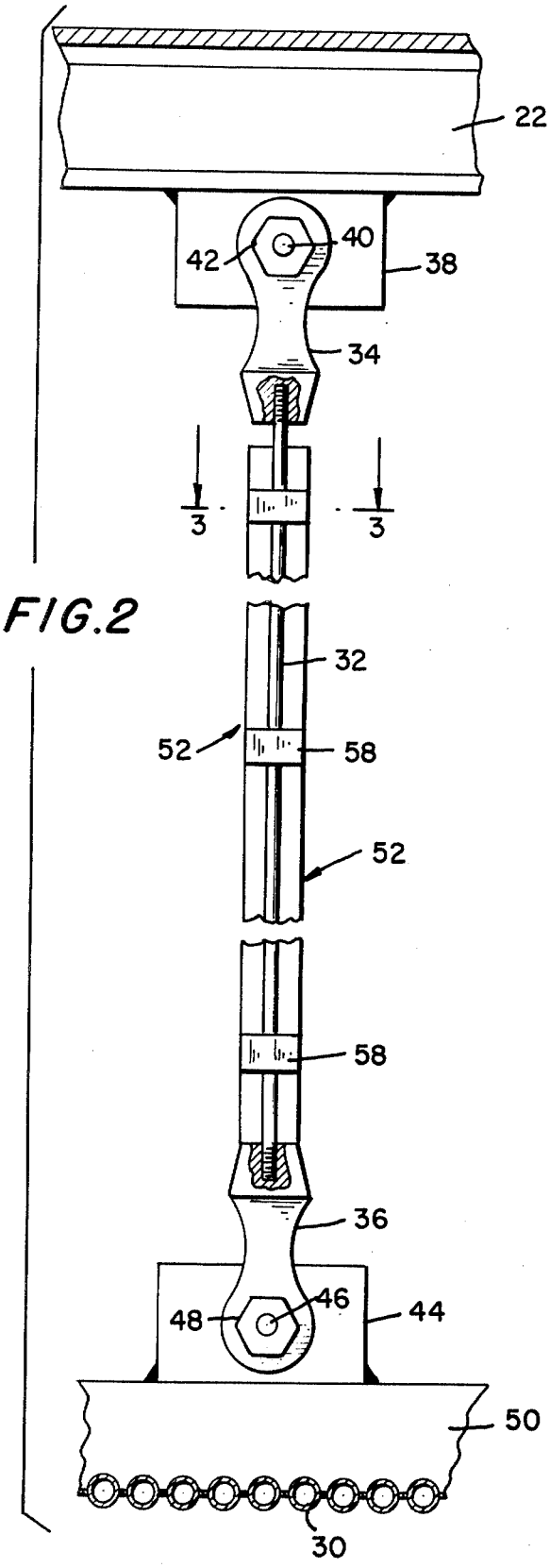
FIG. 2 is a sectional view taken along line 2—2 of FIG. 1 showing the apparatus of the instant invention adapted for use with vapor generator hanger rods.

As shown in FIG. 2, the narrow hanger rod 32 threadedly engages a clevis 34 at its top, and a clevis 36 at its bottom. Clevis 34 is secured to upper plate 38 by means of bolt 40 which extends through the two ears of clevis 34 and also through plate 38. Bolt 40 has a threaded end which engages nut 42 for holding the bolt in place. Plate 38 is welded to support beam 22. Lower clevis 36 is connected to lower plate 44 by means of a bolt 46 extending through ears of clevis 36 and also extending through lower plate 44. Bolt 46 engages nut 48, and is thereby held in place. Lower plate 44 is welded to a scalloped bar 50, the scallops of which match the contour of the roof tubes and are arranged to accommodate welding bar 50 to the top surface of the roof tubes.

Figure 3:
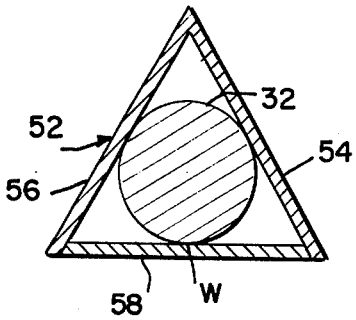
FIG. 3 is a sectional view taken along line 3—3 of FIG. 2, and illustrating the manner in which the apparatus of the instant invention is positioned with respect to a hanger rod.

Rigid bar 52 including coextensive angularly disposed legs 54, 56 is positioned adjacent hanger rod 32, extending between upper clevis 34 and lower clevis 36. The bar 52 is substantially the same length as hanger rod 32, but is spaced away from upper clevis 34 so that the clevis 34 will not engage bar 52 and bar 52 will therefore not be subjected to axial loading. Tie bars 58 are welded along opposite edges to legs 54, 56 of rigid bar 52, and are adapted to hold hanger rod 32 between legs 54, 56 of bar 52, as better shown in FIG. 3. It is to be understood that while a plurality of tie bars 58 are depicted in FIG. 2, a single continuous tie bar could be utilized, which would extend substantially the length of rigid bar 52, and be welded along opposite edges to legs 54, 56 of bar 52. When the plurality of tie bars 58 are used, they are so spaced as to preclude rod 32 from bending outwardly toward tie bars 58. For example, it is contemplated that tie bars 58 could be spaced approximately 18–24 inches apart along the length of rigid bar 32. However, such spacing is merely illustrative of a preferred embodiment. At least one tie bar 58 is tack welded to hanger rod 32 at W to prevent the rigid bar and tie bar assembly from rotating around hanger rod 32.

Figure 4:
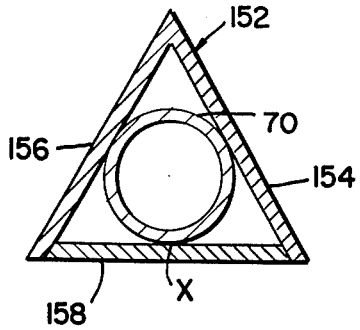
FIG. 4 is a sectional view taken along line 4—4 of FIG. 1 and showing the apparatus of the instant invention adapted for use with a duct pipe truss.

As shown in FIG. 4, a pipe truss assembly 60 is disposed within duct 62 associated with the convection pass outlet 17 of the vapor generator 10. The pipe truss assembly 60 is illustrative of the type of assembly used in vapor generator ductwork; for purposes of illustration it is to be assumed that those truss members to which the instant invention has been adapted are members ordinarily under a tension load, but on occasion will be subjected to a compression load.

A plurality of T-shaped bars 64 extend within the duct 62 in the direction of gas flow through the duct, being attached to the duct along their lengths. Gusset plates 66 are welded to the T-shaped bars 64 for securing the truss members 68, 70 within the duct 62. Truss members 68, 70 are pipes formed with slotted ends which engage a truss plate 66. The slotted ends of each member are welded to the truss plates.

For purposes of illustration, the truss member 70 shown is assumed to be a truss member which is normally under a tensile load, and therefore would have a relatively slender cross section. This truss member is therefore the type of truss member which would tend to buckle if subjected to a compression load.

In discussing the use of the instant invention with a narrow truss member, 100 series reference numbers will be used.

Figure 5:
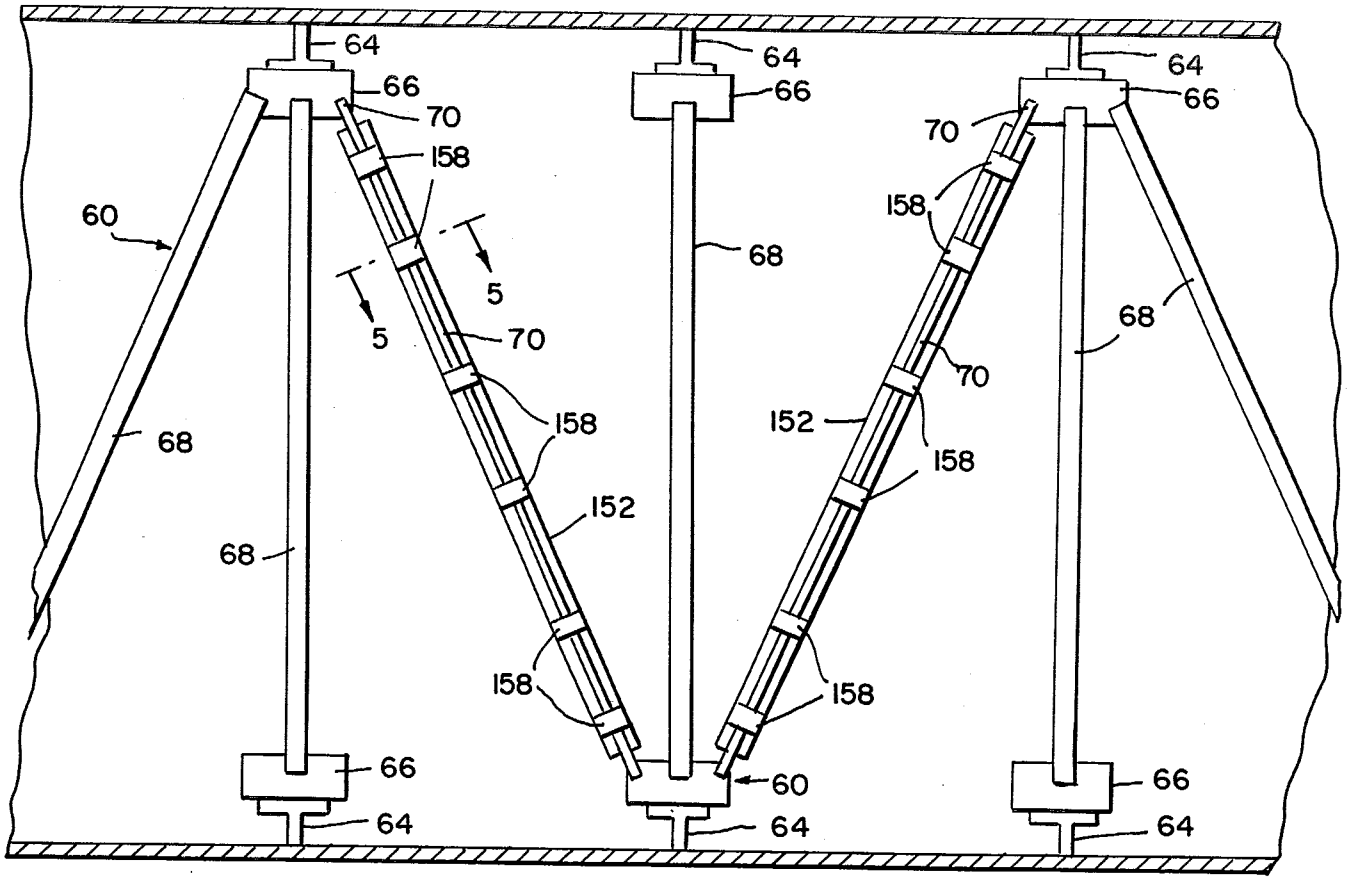
FIG. 5 is a sectional view taken along line 5—5 of FIG. 4, and illustrating the manner in which the apparatus of the instant invention is positioned with respect to a truss member.

Rigid bar 152 including coextensive legs 154, 156 is positioned adjacent truss member 70, extending between gusset plates 66. Bar 152 is spaced away from gusset plates 66 in order that bar 152 will not engage plates 66 and thereby avoid axial loading. Tie bars 158 are welded along opposite edges to legs 154, 156 of rigid bar 152, and are adapted to hold the truss member 70 between legs 154, 156 of bar 152; as better shown in FIG. 5. As explained abofe, the tie bar 158 could comprise a single continuous bar welded along its opposite edges to legs 154, 156 of bar 152. When a plurality of narrow tie bars 158 are used, they are so spaced as to preclude truss member 70 from bending toward the tie bars. At least one tie bar 158 is tack welded to the truss member 70 at X to prevent the rigid bar and tie bar assembly from rotating around the truss member 70.

In operation, if tubes of roof 30 tend to move upwardly, a compression load is applied to hanger rod 32. Because rods 32 are relatively slender, they tend to buckle under a compression load. As rod 32 tends to buckle, it engages bar 52 and/or tie bars 58 which prevent hanger rod 32 from buckling by absorbing a load in a plane normal to the longitudinal axis of rod 32. Therefore rods 32 can withstand a compression load, and restrain roof 30 from moving upwardly. As a result, there occurs no such relative movement between roof 30 and various elements such as wall 31 and superheater 33, and the seal plates 35 are not torn free. If the pressure within duct 62 changes so as to convert the load normally applied to some truss members such as member 70 into a compression load, the member 70 contacts bar 152 and/or tie bars 158. The bars 152, 158 prevent the member 170 from buckling, and thereby preclude damage to duct 62.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the scope of the invention herein.

What is claimed is:

1. Apparatus for preventing buckling of a narrow member which member is subjected to a compression load comprising a rigid bar of substantially the same length as said member, one end of said rigid bar being spaced away from a respective end of said narrow member such that said rigid bar is not subjected to axial loading, said bar including first and second angularly disposed legs, each of said legs being adapted to contact said member along the length of said legs, and means for maintaining said member in contact with said bar, said means including a tie bar connected between said legs of said rigid bar and adapted to engage said member at its outer surface at a point spaced apart from the points of contact of said member with said legs, said rigid bar being adapted such that said member applies a load to said rigid bar or to said tie bar at said points of contact in a plane normal to the longitudinal axis of said member.

2. The apparatus of claim 1 further comprising means for connecting said tie bar to said member.

3. The apparatus of claim 2 further comprising additional tie bars disposed along the length of said rigid bar, each of said additional tie bars being connected between said legs of said rigid bar and each respective additional tie bar being adapted to engage said member at points spaced apart from the points of contact of said member with said legs.

4. The apparatus of claim 1 wherein said narrow member comprises a hanger rod and wherein said legs define a V-shaped cross section for said rigid bar, said hanger rod being positionable within said V, said tie bar extending across the outer surface of said hanger rod and engaging said hanger rod at a point spaced apart from the points of contact of said member with said legs.

5. The apparatus of claim 1 wherein said narrow member comprises a hanger rod connected between a laterally extending support beam and the roof of a vapor generator, said rigid bar extending between said beam and said roof, and said tie bar being welded at opposite edges to said legs so as to maintain said hanger rod in contact with said legs of said rigid bar.

6. The apparatus of claim 1 wherein said narrow member comprises a duct truss member extending within said duct and between opposing walls of said duct, said rigid bar extending parallel to said truss member, and said tie bar being welded along opposite edges of said legs of said rigid bar so as to maintain said truss member in contact with said legs of said rigid bar.

7. The apparatus of claim 5 further comprising means for connecting said tie bar to said hanger rod.

8. The apparatus of claim 6 further comprising means for connecting said tie bar to said truss member.

* * * * *